US011239569B2

(12) United States Patent
Dufilie

(10) Patent No.: US 11,239,569 B2
(45) Date of Patent: Feb. 1, 2022

(54) OCTAVE BAND STACKED MICROSTRIP PATCH PHASED ARRAY ANTENNA

(71) Applicant: Massachusetts Institute of Technology, Cambridge, MA (US)

(72) Inventor: Pierre A. Dufilie, Marlborough, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 148 days.

(21) Appl. No.: 16/804,814

(22) Filed: Feb. 28, 2020

(65) Prior Publication Data

US 2020/0287294 A1 Sep. 10, 2020

Related U.S. Application Data

(60) Provisional application No. 62/813,401, filed on Mar. 4, 2019.

(51) Int. Cl.

| | |
|---|---|
| ***H01Q 1/38*** | (2006.01) |
| ***H01Q 21/06*** | (2006.01) |
| ***H01Q 5/307*** | (2015.01) |
| ***H01Q 9/04*** | (2006.01) |

(52) U.S. Cl.

CPC ..... *H01Q 21/065* (2013.01); *H01Q 5/307* (2015.01); *H01Q 9/0414* (2013.01)

(58) Field of Classification Search

CPC ..... H01Q 21/065; H01Q 5/307; H01Q 9/0414
See application file for complete search history.

(56) References Cited

U.S. PATENT DOCUMENTS

| | | | | |
|---|---|---|---|---|
| 2011/0291909 | A1* | 12/2011 | Heckler | H01Q 1/521 343/846 |
| 2015/0333407 | A1* | 11/2015 | Yamagajo | H01Q 5/40 343/905 |
| 2018/0090852 | A1 | 3/2018 | Dufilie et al. | |
| 2018/0269585 | A1* | 9/2018 | Kim | H01Q 25/001 |

FOREIGN PATENT DOCUMENTS

| | | |
|---|---|---|
| CN | 107634337 | 1/2018 |
| KR | 101602575 | 3/2016 |

OTHER PUBLICATIONS

Search Report of the ISA dated May 29, 2020 for International Application No. PCT/US2020/020762; 5 Pages.
Wincza, et al.; "Octave-Band Aperture-Stacked Microstrip Antenna Element for Wideband Antenna Arrays"; IEEE International Symposium on Antenna and Propagation; pp. 1579-1580; Oct. 27, 2016; 2 Pages.
Written Opinion of the ISA dated May 29, 2020 for International Application No. PCT/US2020/020762; 6 Pages.

* cited by examiner

*Primary Examiner* — Dieu Hien T Duong
(74) *Attorney, Agent, or Firm* — Daly, Crowley, Mofford & Durkee LLP

(57) ABSTRACT

Described is a stacked patch antenna array scan-capable to 55 degrees and operable over an octave or greater frequency bandwidth.

14 Claims, 3 Drawing Sheets

OCTAVE BAND STACKED MICROSTRIP PATCH PHASED ARRAY ANTENNA

CROSS-REFERENCE TO RELATED APPLICATION

The present application claims the benefit of U.S. Provisional Application 62/813,401, titled "Octave Band Stacked Microstrip Patch Phased Array Antenna," filed on Mar. 4, 2019. The entire disclosure of which is hereby incorporated by reference in its entirety.

GOVERNMENT RIGHTS

This invention was made with Government support under Grant No. FA8702-15-D-0001 awarded by the U.S. Air Force. The Government has certain rights in the invention.

FIELD

The subject matter described herein relates generally to radio frequency (RF) antennas and more particularly to stacked-patch antenna arrays.

BACKGROUND

As is known in the art, it is desirable to provide antenna arrays which operate over a wide range of frequencies and over a wide range of scan angles.

SUMMARY

The present disclosure relates to microstrip antenna designs and more particularly to stacked patch antenna designs capable of achieving wide operational scan angles (e.g. scan-capable to 55 degrees or greater) which operate over an octave or greater frequency bandwidth. Such stacked patch antenna designs find use in a wide range of applications including, but not limited to, space-based systems and airborne systems (e.g. space-based and airborne radar systems and communication systems which utilize array antennas). The concepts, systems and techniques described herein may be used in any application requiring antenna arrays capable of operating over a wide range of frequencies and over a wide range of scan angles.

It should be appreciated that the concepts, systems and techniques described herein are scalable meaning that antennas provided in accordance with the described concepts, systems and techniques may operate at any frequency in the radio frequency (RF) range (e.g. the range of about 3 kHz to about 300 GHz) assuming required manufacturing tolerances are satisfied.

The stacked patch antenna array described herein may be used for detecting radiation between a first frequency, having an associated wavelength A, and a second frequency that is at least twice the first frequency. The antenna array has a plurality of unit cells, and each unit cell includes a first substrate having one or more patch elements disposed thereon and one or more second substrates disposed over the first substrate and having one or more patch elements disposed thereon, Each unit cell further includes a matching network coupled between RF antenna ports and the lower patch antenna.

In embodiments, each unit cell has a first substrate having a thickness of about 0.0203λ and a relative permittivity of about 15. A first ground plane is disposed on a lower surface of the first substrate. A second substrate having a thickness of about 0.0203λ and a relative permittivity of about 3.7 is disposed over the first substrate. An impedance matching network is disposed between the first and second substrates, the impedance matching network having an RF port and an antenna port. A first via extends from the RF port to an output port of the unit cell. A third substrate having a thickness of about 0.0373λ and a relative permittivity of about 3.0 is disposed over the second substrate. A second ground plane is disposed between the second and third substrates, A fourth substrate having a thickness of about 0.0406λ and a relative permittivity no greater than about 1.25, and preferably about 1.15 is disposed over the fourth substrate. A lower patch antenna element is disposed between the third and fourth substrates. A second via extends from the lower patch element to the antenna port. A fifth substrate is disposed over the fourth substrate. An upper patch antenna element is disposed on an upper surface of the fifth substrate.

In embodiments, the impedance matching network comprises a first matching section having an impedance of about 1000 and a length of about 25.8 at the first frequency, and a second matching section having an impedance of about 770 and a length of about 83.3 at the first frequency.

In some embodiments, each unit cell further comprises a second output port; in the impedance matching network, a second RF port and a second antenna port; a third via extending from the second RF port to the second output port; and a fourth via extending from the lower patch element to the second antenna port.

In some embodiments, each unit cell further comprises one or more grounding vias extending from the first ground plane to the second ground plane.

In some embodiments, the plurality of patch elements are configured for operation in different frequency bands, or in different polarizations, or both.

In some embodiments, the fifth substrate of each unit cell has a thickness selected to provide mechanical support to the upper patch antenna. In embodiments, the thickness is selected to be as thin as possible while still providing mechanical support.

In some embodiments, the fifth substrate of each unit cell has a relative permittivity of about 3.0.

Some embodiments further have, in each unit cell, a sixth substrate disposed over the fifth substrate and over the upper patch antenna.

In some such embodiments, the sixth substrate of each unit cell has a thickness suitable to tune the corresponding upper and lower patch antenna elements. One purpose of the tuning is to adjust the impedance match over the band of operation and/or to control (e.g. increase), and ideally optimize, the bandwidth of the antenna element (and any array antenna comprised of such elements) to suit the needs of the particular application.

In some such embodiments, the sixth substrate of each unit cell has a relative permittivity of about 3.0.

In some embodiments, a length and a width of each unit cell are about 0.2371λ.

In some embodiments, a length and a width of the lower patch antenna element in each unit cell are 0.1626λ.

In some embodiments, a length and a width of the upper patch antenna element in each unit cell are 0.1355λ.

It is appreciated that the above disclosed embodiments are illustrative only, and that the concepts, techniques, and structures disclosed herein may be embodied in other ways by a person having ordinary skill in the art.

BRIEF DESCRIPTION OF THE DRAWINGS

The foregoing features may be more fully understood from the following description of the drawings in which:

FIG. 3 is a top view of an array antenna provided from a plurality of unit cells which may be the same as or similar to the unit cells described in FIGS. 1 and 2.

DETAILED DESCRIPTION

In the description that follows, various features, concepts, systems and techniques are described in the context of a stacked-patch antenna array. It should be appreciated that these features, concepts, systems and techniques may also be used with other types of planar or conformal radiating structures and surfaces.

Before describing a stacked patch antenna array having a matching network, some introductory concepts are explained. As described herein a space-based (or space-borne system) refers to any system deployed beyond the earth's atmosphere while "airborne" systems refer to any system deployed within the earth's atmosphere. Both space-borne and airborne systems may have any of a variety of different purposes. A space-based radar, for example, refers to radar systems deployed beyond the earth's atmosphere which may be used for object detection or other purposes. Similarly, a space-based communication system refers to communications systems deployed beyond the earth's atmosphere. Certain radar and telecommunication systems may be provided as a collection of individual components such as communications networks, transmission systems, relay stations, tributary stations, and data terminal equipment (DTE) usually capable of interconnection and interoperation to form an integrated whole. Thus, both space-based and airborne radar or communication systems refer to systems in which at least some components are space-borne or airborne.

Furthermore, it should also be appreciated that features, concepts, systems and techniques described herein find use in antenna arrays for any application including, but not limited to space-based, airborne, ground-based, or water-based applications.

Figure 1:
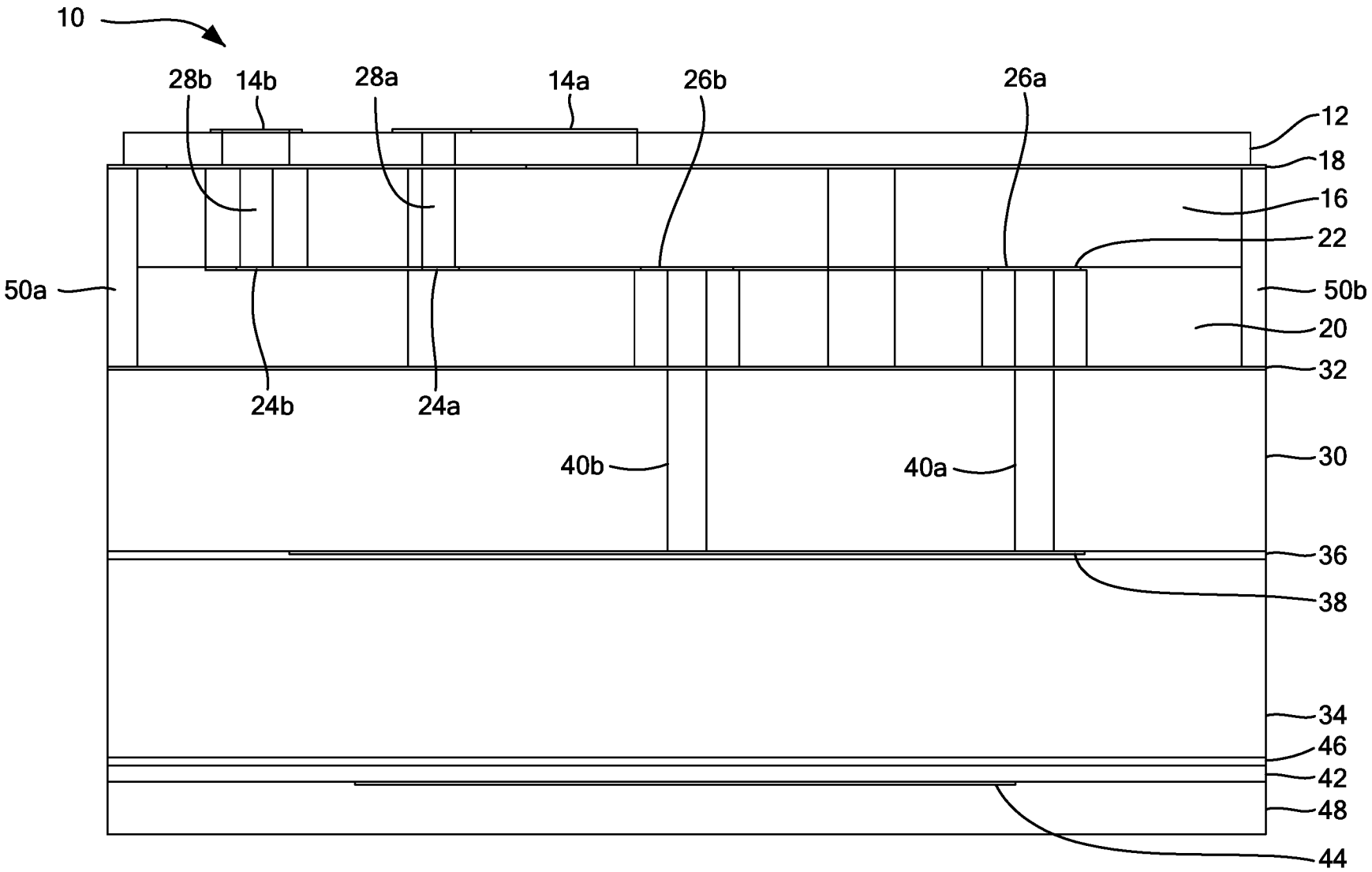
FIG. 1 is a cross-sectional view of a unit cell of a stacked-patch antenna array having a matching circuit.
Figure 2:
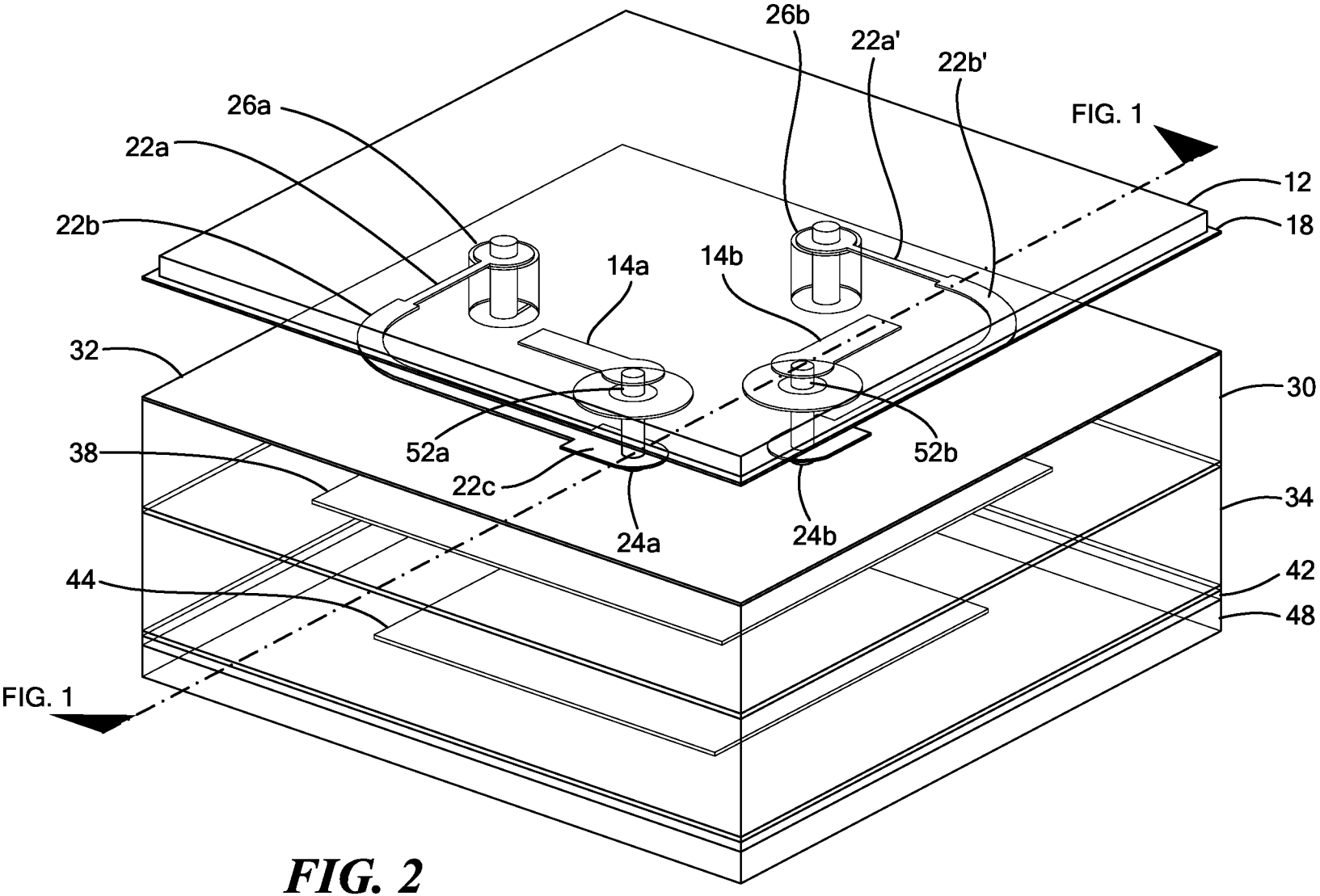
FIG. 2 is an isometric view of the underside of a unit cell of a stacked-patch antenna array having a matching circuit.

Referring now to FIGS. 1 and 2 in which like elements are provided having like reference designations, a unit cell 10 of a stacked-patch antenna is shown. The stacked-patch antenna is designed to detect radiation between a first frequency and a second frequency within the radio frequency (RF) band. The first frequency, referred to herein as $f_1$, may be associated with a corresponding wavelength, referred to herein as $\lambda_1$ or simply $\lambda$, by the well-known formula $\lambda_1=c/f_1$ where c=299,792,458 m/s is the speed of light in a vacuum. In embodiments, the first and second frequencies are separated by at least an octave; that is, the second frequency is at least twice the first frequency. The octave bandwidth may be achieved, for example, by selection of upper and lower patch antennas dimensions (e.g. the length and width of the upper and lower patch antennas in the case of an antenna element having a rectangular or square shape), the height of the patch antennas from the ground plane (i.e. spacing or distance of the patch antennas from a surface of the ground plane to a surface of the patch antenna), the choice of the dielectric constants of certain substrates (e.g. referred to as the 3rd, 4th, and 5th substrates herein below), and the impedance values and phase lengths of matching sections. All of these different variables cooperate to result in an antenna capable of operating over an octave frequency bandwidth.

Accordingly, the combination of radiator design and matching network as described herein result in an antenna capable of operating over an octave bandwidth. It should be appreciated that although a specific example of a matching network is described herein, such an example is not intended to be and should not be construed as limiting. Rather, after reading the disclosure provided herein, one of ordinary skill in the art will recognized that matching networks having similar electrical characteristics (e.g. similar S-parameters over similar operating frequencies) to the example matching network described herein may also be used. Thus, in embodiments, matching networks which may be electrically the same as or similar to (e.g. using the impedances and phase lengths disclosed herein) the example matching network disclosed herein may be used. For example, a matching network having different choices for the 1st and 2nd substrates in the example provided herein (whether different in thickness and/or or dielectric constant and/or with respect to some other electrical and/or mechanical characteristic) may be used.

It is appreciated that the frequencies (respectively wavelengths) of radiation to which the disclosed antenna is responsive, scale linearly with the dimensions of the antenna. That is to say, if each linear dimension of the antenna is multiplied by a factor M (where M is any real number), then the wavelengths detectable by the antenna are multiplied by the same factor M and the frequencies detectable by the antenna are divided by by the same factor M. A person of ordinary skill will understand how to scale the antenna to achieve a desired frequency octave for detecting radiation in accordance with an associated use. Therefore, the components of unit cell 10 of FIGS. 1 and 2 are described as having dimensions relative to a desired wavelength A of the lower frequency $f_1$.

The unit cell 10 illustratively includes, for prototyping or testing purposes, an optional substrate 12, The optional substrate 12 may be any material having a thickness of about 0.0068λ and a relative permittivity in the range of about 3.6 to 3.8 and preferably of about 3.7. The unit cell 10 further illustratively includes, for prototyping or testing purposes, a first output port 14*a* on a lower surface of the optional substrate 12, The unit cell 10 may further include a second output port 14*b* on the lower surface of the optional substrate 12. The substrate 12 and first and second output ports 14*a*, 14*b* are shown for illustrative purposes only, and may or may not appear in embodiments of the invention as used in an operational environment.

The unit cell 10 also includes a first substrate 16. The first substrate 16 may be any material having a thickness of about 0.0203λ and a relative permittivity in the range of about 3.4 to 3.6 and preferably of about 3.5.

The unit cell 10 further includes a ground plane 18 disposed on a lower surface of the first substrate 16. The ground plane 18 may be any suitable conductor, such as copper, and may be placed on the lower surface of the first substrate 16 using any technique, including any additive or subtractive technique, known to those of ordinary skill in the art.

The unit cell 10 further includes a second substrate 20 disposed over the first substrate 16. The second substrate 20 may be any material having a thickness of about 0.0203λ and a relative permittivity in the range of about 3.5 to 3.8 and preferably of about 3.7.

The unit cell 10 further includes an impedance matching network 22 disposed between the first substrate 16 and the second substrate 20. The impedance matching network 22 has an RF port 24*a* and an antenna port 26*a*. In some embodiments, the impedance matching network 22 may have a second RF port 24*b* and a second antenna port 26*b*.

The unit cell 10 further includes a via 28*a* extending from the RF port 24*a* to the output port 14*a* of the unit cell. The unit cell 10 may include a via 28*b* extending from the second RF port 24*b* to a second output port 14*b* in appropriate embodiments.

The unit cell 10 further includes a third substrate 30 disposed over the second substrate 20. The third substrate 30 may be any material having a thickness of about 0.0373λ and a relative permittivity in the range of about 2.9 to 3.1 and preferably of about 3.0.

The unit cell 10 further includes a second ground plane 32 disposed between the second substrate 20 and the third substrate 30. The second ground plane 32 may be any suitable conductor, such as copper, and may be disposed between the third and fourth substrates using any technique, including any additive or subtractive technique, known to those of ordinary skill in the art.

In some embodiments, the unit cell 10 further includes grounding vias 60*a*, 50*b* extending from the first ground plane 18 to the second ground plane 32. These grounding vies 50*a*, 50*b* may prevent the appearance of certain modes in the output of the unit cell 10. A person of ordinary skill in the art should appreciate how to size and place such grounding vies 50*a*, 50*b*.

The unit cell 10 further includes a fourth substrate 34 disposed over the third substrate 30. The fourth substrate 34 may be any material having a thickness of about 0.0406λ, a relative permittivity in the range of 1.0 to about 125 and preferably no greater than about 1.15, and a low dielectric loss δ (i.e., a material for which tan δ≈δ). In particular, the fourth substrate 34 may be a foam spacer. It is appreciated that in some embodiments, the foam spacer may be omitted, and the corresponding space (having a thickness of about 0.0406λ) may be flied with vacuum, air, or other material having a suitable permittivity.

The fourth substrate 34 may be affixed to an upper surface of the third substrate 30 using a layer of adhesive 36, such as glue. The adhesive 36 preferably is applied as thinly as possible to securely affix the third and fourth substrates 30, 34.

The unit cell 10 further includes a lower patch antenna element 38 disposed between the third substrate 30 and the fourth substrate 34. The lower patch antenna element 38 may be any conductor, such as copper.

The unit cell 10 further includes a via 40*a* extending from the lower patch element 38 to the antenna port 26*a*. The unit cell 10 may include a via 40*b* extending from the lower patch element 38 to the second antenna port 26*b* in appropriate embodiments.

The unit cell 10 further includes a fifth substrate 42 disposed over the fourth substrate 34, and an upper patch antenna element 44 disposed on an upper surface of the fifth substrate 42. The fifth substrate 42 may be any material of sufficient thickness to provide structural support to the upper patch antenna 44, but is preferably as thin as possible. In an illustrative embodiment, the fifth substrate 42 has a thickness of about 0.0034λ and a relative permittivity in the range of about 2.9 to 3.1 and preferably of about 3.0.

The fifth substrate 42 may be affixed to an upper surface of the fourth substrate 34 using a layer of adhesive 46, such as glue. The adhesive 46 should be as thin as possible to securely affix the fourth and fifth substrates 34, 42.

The upper patch antenna element 44 may be any conductor, such as copper. The combination of the substrates 30, 34, 42 and associated patch antenna elements 38, 44 together provide the stacked-patch antenna of the unit cell 10.

The unit cell 10 may, in some embodiments, include a sixth substrate 48 disposed over the fifth substrate 42. The sixth substrate 48 may be any material, and may serve to cover an exposed upper patch element 44 (if the desired use of the antenna array so requires), or to tune the stacked-patch antenna of the unit cell. In a preferred embodiment, the sixth substrate 48 has a thickness of about 0.0102λ and a relative permittivity in the range of about 2.9 to 3.1 and preferably of about 3.0.

As may be most clearly seen in FIG. 2, the unit cell 10 includes an impedance matching network 22. As indicated above, the impedance matching network 22 has an RF port 24*a* and an antenna port 26*a*. In some embodiments, the impedance matching network 22 also has a second RF port 24*b* and a second antenna port 26*b*. Moreover, the impedance matching network 22 includes, between pairs of these respective ports, an impedance matched to a load placed across the output ports 14*a* and 14*b*.

In some embodiments, the impedance matching network 22 comprises a first matching section 22*a* (of e.g. stripline) having an impedance in the range of about 90Ω-110Ω and preferably of about 100Ω and a length of about 25.8° (i.e. about $0.0716\lambda_e$ where $\lambda_e$ is an effective wavelength which corresponds to a wavelength in the dielectric) at the first frequency $f_1$, and a second matching section 22*b* having an impedance in the range of about 70Ω-84Ω and preferably of about 77Ω and a length of about 83.3° (i.e. about $0.2314\lambda_e$) at the first frequency $f_1$. To match impedance with an attached, particular operational load, the impedance matching network 22 may further include an output section 22*c*, In an illustrative embodiment, this output section 22*c* has an impedance of 50Ω. It is appreciated that the above values, used to match the impedance of the antenna to that of an attached test load, are illustrative only, and that different conductors used in construction of the antenna and different attached loads may necessitate different values.

As may also be seen in FIG. 2, the ground plane 18 is provided having openings (or "reliefs") 52*a*, 52*b* to accept probe-type feeds (e.g. pin feeds). Thus, each antenna element is fed from a pair of pins disposed through respective ones of opening 52*a*, 52*b* such that each antenna element maybe fed with two orthogonal polarizations (e.g. vertical and horizontal polarizations). Those of ordinary skill will appreciate that other types of feed structures may also be used including, but not limited to, capacitive feed structures. Those of ordinary skill in the art will understand how to select a feed circuit which is appropriate to suit the needs of a particular application.

Such stacked patch antenna array structures are capable of operation over a bandwidth which is wider than a single level antenna with little or no increase in physical size. In various embodiments, an antenna array comprised of such unit cells 10 may operate over a frequency range of an entire octave or more.

In some embodiments, the antenna elements used in the stacked patch antenna array may be configured for operation in different frequency bands and/or different polarizations. For example, as explained above, the linear dimensions of the unit cell 10 may be scaled to achieve a desired frequency octave for detecting radiation in accordance with an associated use.

Figure 3:
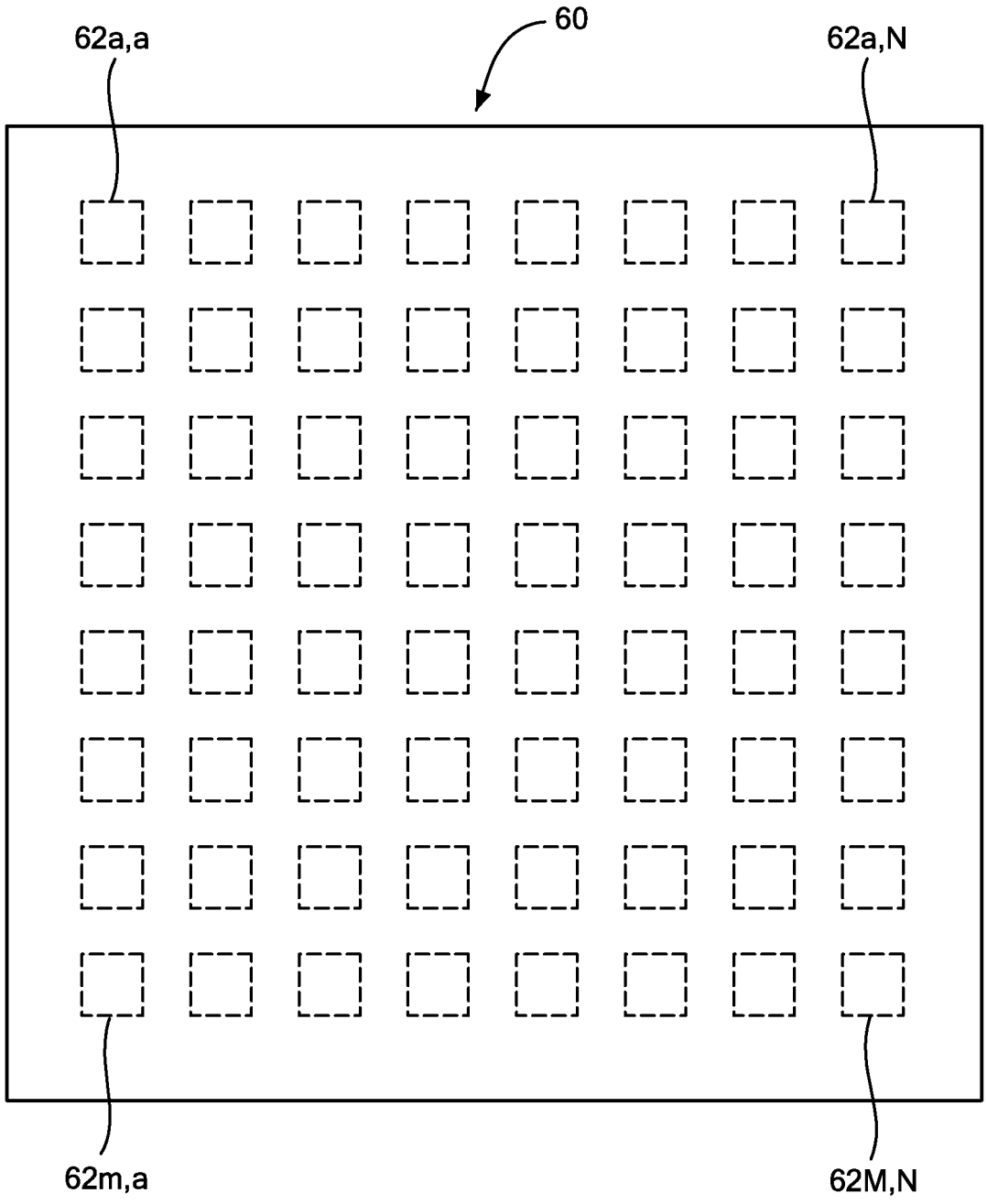
FIG. 3 is an array antenna provided from a plurality of unit cells which may be the same as or similar to the unit cell of FIG. 1.

Referring to FIG. 3, an array antenna 60 includes a plurality of unit cells $\mathbf{62}_{aa}$-$\mathbf{62}_{MN}$ (or elements) which may be the same as or similar to the unit cells described above in conjunction with FIG. 1. Thus, array antenna is a stacked-patch array antenna capable of operating over a frequency bandwidth with the highest frequency of operation being at least twice the lowest frequency of operation. That is array antenna 60 operates over a frequency bandwidth which is at least an octave.

In this example, array antenna has M rows and N columns where M and N are integers and may or may not be of equal value (i.e. the number of rows in array antenna 60 may be different than the number of columns in array antenna 60). It should, of course, be appreciated that array antenna may have any regular geometric shape (e.s. rectangular, circular, etc. . . . ) or may have an irregular geometric shape. Furthermore, the array antenna may have any lattice pattern (e.g. a regular pattern such as rectangular, triangular, circular, or irregular pattern).

It will thus be clear to one of ordinary skill in the art that the concept described herein apply to any array antenna having any particular array shape and/or size (e.g., a particular number of antenna elements or a particular number of rows and columns) One of ordinary skill in the art will also appreciate that the techniques described herein are applicable to various sizes and shapes of array lattice configurations. Thus, the antenna elements $\mathbf{62}_{aa}$-$\mathbf{62}_{MN}$ may be arranged in a variety of different lattice arrangements including, but not limited to, periodic lattice arrangements or configurations (e.g. rectangular, circular, equilateral or isosceles triangular and spiral configurations) as well as non-periodic or other geometric arrangements including arbitrarily shaped geometries.

As used herein, the terms "optimal," optimized, and the like do not necessarily refer to the best possible configuration of an antenna to achieve a desired goal over all possible configurations, but can refer to the best configuration that was found during an optimization procedure given certain limits of the procedure.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

An illustrative embodiment is described in further detail in the Appendix attached hereto,

What is claimed is:

1. An antenna array for detecting radiation between a first frequency, having an associated wavelength $\lambda_1$, and a second frequency that is at least twice the first frequency and having an associated wavelength $\lambda_2$, the antenna array comprising a plurality of unit cells, each such unit cell comprising:

a first substrate having a thickness of $0.0203\lambda_1$ and a relative permittivity of about 3.5;

a first ground plane disposed on a lower surface of the first substrate;

a second substrate disposed over the first substrate and having a thickness of $0.0203\lambda_1$ and a relative permittivity of about 3.7;

an impedance matching network disposed between the first and second substrates, the impedance matching network having an RE port and an antenna port;

a first via extending from the RF port to an output port of the unit cell;

a third substrate disposed over the second substrate and having a thickness of $0.0373\lambda_1$ and a relative permittivity of about 3.0;

a second ground plane disposed between the second and third substrates;

a fourth substrate disposed over the third substrate and having a thickness of $0.0406\lambda_1$ and a relative permittivity no greater than about 1.25;

a lower patch antenna element disposed between the third and fourth substrates;

a second via extending from the lower patch element to the antenna port;

a fifth substrate disposed over the fourth substrate; and an upper patch antenna element disposed on an upper surface of the fifth substrate.

2. The antenna array of claim 1 wherein the impedance matching network comprises a first matching section having an impedance of 100Ω and a length of 25.8° at the first frequency, and a second matching section having an impedance of 77Ω and a length of 83.3° at the first frequency.

3. The antenna array of claim 1, wherein each unit cell further comprises:

a second output port;

in the impedance matching network, a second RF port and a second antenna port;

a third via extending from the second RF port to the second output port; and a fourth via extending from the lower patch element to the second antenna port.

4. The antenna array of claim 1, wherein each unit cell further comprises one or more grounding vias extending from the first round plane to the second ground plane.

5. The antenna array of claim 1, wherein the plurality of patch elements are configured for operation in different frequency bands, or in different polarizations, or both.

6. The antenna array of claim 1, wherein the fifth substrate of each unit cell has a minimum thickness that provides mechanical support to the upper patch antenna.

7. The antenna array 4 claim 1, wherein the fifth substrate of each unit cell has a relative permittivity of about 3.0.

8. The antenna array of claim 1, further comprising, in each unit cell, a sixth substrate disposed over the fifth substrate and over the upper patch antenna.

9. The antenna array of claim 8, wherein the sixth substrate of each unit cell has a thickness suitable to tune the corresponding upper and lower patch antenna elements.

10. The antenna array of claim 8, wherein the sixth substrate of each unit cell has a relative permittivity of about 3.0.

11. The antenna array of claim 1, wherein a length and a width of each unit cell are $0.2371\lambda_1$.

12. The antenna array of claim 1 wherein a length and a width of the lower patch antenna element in each unit cell are $0.1626\lambda_1$.

13. The antenna array of claim 1, wherein a length and a width of the upper patch antenna element in each unit cell are $0.1355\lambda_1$.

14. The antenna array of claim 1, wherein the relative permittivity of the fourth substrate is about 1.15.

* * * * *